United States Patent [19]

Carlson et al.

[11] Patent Number: 4,608,908

[45] Date of Patent: Sep. 2, 1986

[54] ELECTROMAGNETIC LAUNCHERS WITH IMPROVED RAIL CONFIGURATIONS

[75] Inventors: Richard J. Carlson, Santa Clara, Calif.; George A. Kemeny, Wilkins Township, Allegheny County, Pa.

[73] Assignee: Westinghouse Electric Corp., Pittsburgh, Pa.

[21] Appl. No.: 571,609

[22] Filed: Jan. 17, 1984

[51] Int. Cl.[4] ..... F41F 1/02

[52] U.S. Cl. ..... 89/8; 124/3; 310/12

[58] Field of Search ..... 89/8; 124/3; 310/10–14; 318/135; 336/223, 70

[56] References Cited

U.S. PATENT DOCUMENTS

| | | | |
|---|---|---|---|
| 854,774 | 5/1907 | Taylor | 336/223 |
| 1,370,200 | 3/1921 | Fauchon-Villeplee | 89/80 X |
| 1,421,435 | 7/1922 | Fauchon-Villeplee | 310/13 X |
| 2,604,519 | 7/1952 | Mackereth | 336/223 X |
| 3,126,789 | 3/1964 | Meyer | 124/3 X |
| 3,431,816 | 3/1969 | Dale | 124/3 X |
| 4,347,463 | 8/1982 | Kemeny et al. | 89/8 |
| 4,433,608 | 2/1984 | Deis et al. | 310/13 X |
| 4,449,441 | 5/1984 | McAllister | 124/3 X |
| 4,480,523 | 11/1984 | Young et al. | 124/3 X |
| 4,485,720 | 12/1984 | Kemeny | 124/3 X |

OTHER PUBLICATIONS

J. P. Barber, "The Acceleration of Macroparticles and Hypervelocity Electromagnetic Accelerator", The Australian National Univ., EP-T12, pp. 33–89, Mar. 1972.

*Primary Examiner*—David H. Brown
*Assistant Examiner*—John E. Griffiths
*Attorney, Agent, or Firm*—R. P. Lenart

[57] ABSTRACT

An electromagnetic projectile launcher is provided with a pair of parallel conductive projectile launching rails which are generally T-shaped with a significant current carrying cross section located symmetrically around a horizontal bore center line. Augmenting conductors which may be either series or parallel connected are located adjacent to the projectile launching rails. In favorable embodiments, force augmentation is also achieved by a reduction in launcher rail height from the breech to the muzzle end.

11 Claims, 10 Drawing Figures

ELECTROMAGNETIC LAUNCHERS WITH IMPROVED RAIL CONFIGURATIONS

BACKGROUND OF THE INVENTION

This invention relates to electromagnetic projectile launchers and more particularly to such launchers which utilize projectile launching rails having controlled cross-sectional shapes to improve projectile accelerating forces.

In a parallel rail electromagnetic launcher, a force accelerates a current carrying conductor in a magnetic field and this force is equal to the vector cross product of the current density and the magnetic flux density. It can be shown that this force is equal to $\frac{1}{2} L'I^2$ where $L'$ is the inductance gradient of the parallel rail configuration and I is the current. Since the magnetic field which interacts with and therefore accelerates a current carrying conducting armature or plasma is primarily produced by the conducting rails just in the wake of the armature, for example, the field produced by the time dependent current distribution which exists in the rails not more than about three bore widths behind the armature, the accelerating force is similarly a function of that instantaneous current distribution in the conducting rails right in the vicinity of the armature or driving plasma. Therefore it should be understood that the significant value of $L'$ is the inductance gradient existing in the current conducting rails right behind the armature. Simple parallel rail launchers of the prior art have used rectangular cross section projectile launching rails and designs have been proposed wherein the bore is circular and the rails are then essentially formed from annular sectors. Although such rails have been shown to be practical, substantial projectile acceleration improvements can be obtained by utilizing rail cross sections which result in higher acceleration forces in, for example, the breech area, and other configurations which can be utilized to increase accelerating force where the projectile is already traveling at a high speed and when the accelerating current has been reduced. The present invention utilizes particular rail configurations to achieve acceleration improvements.

SUMMARY OF THE INVENTION

An electromagnetic projectile launcher constructed in accordance with the present invention comprises: a pair of generally parallel conductive projectile launching rails, each having an internal surface, an external surface and a longitudinal protuberance extending from the external surface; a source of current connected to the rails; and means for conducting current between the rails and for propelling a projectile along the rails. In the preferred embodiment, the longitudinal protuberance is generally disposed along the mid-plane of the rails. The internal and external rail surfaces may be planar or arcuate. To increase accelerating forces, augmenting conductors can be inserted adjacent to the external surface and on opposite sides of the longitudinal protuberance. In an alternative embodiment, projectile launching rails of rectangular cross section, with decreasing cross-sectional area toward the muzzle, can be utilized alone or in conjunction with a pair of augmenting conductors disposed adjacent to the external surface of each of the projectile launching rails. These conductors may be connected either in series or in parallel and the force on a projectile is further increased by decreasing the height of the projectile launching rails as the rails extend from the breech end to the muzzle end of the launcher.

DESCRIPTION OF THE PREFERRED EMBODIMENTS

Figure 1:
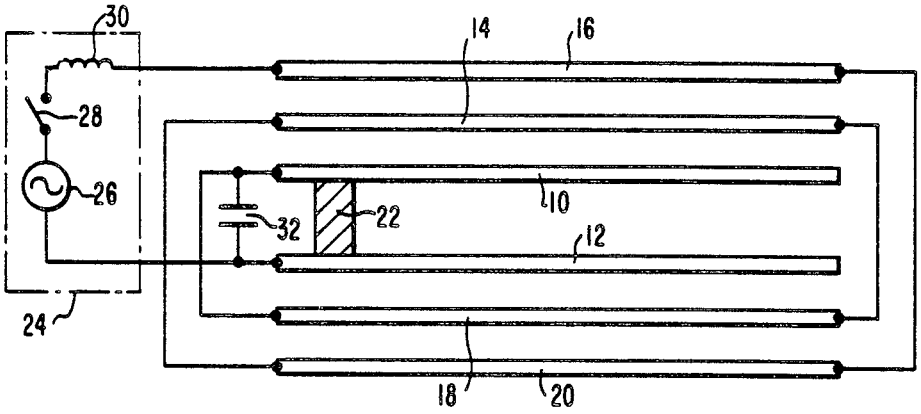
FIG. 1 PRIOR ART
FIG. 1 is a schematic diagram of an electromagnetic projectile launcher having rails and conductors electrically connected in accordance with the prior art.

Referring to the drawings, FIG. 1 is a schematic diagram of a prior art parallel rail electromagnetic projectile launcher which may be modified to include a launching rail system in accordance with the present invention. This launcher comprises a pair of generally parallel conductive projectile launching rails 10 and 12 which are connected in series with augmenting conductors 14, 16, 18 and 20 such that, during projectile acceleration, augmenting conductors 14 and 16 conduct current in the same direction as projectile launching rail 10, while augmenting conductors 18 and 20 carry current in the same direction as projectile launching rail 12. A sliding conductive armature or plasma 22 serves as means for conducting current between the projectile launching rails and for propelling a projectile along those rails. A source of current 24 comprising the series connection of generator 26, switch 28 and optional inductor 30 is connected to augmenting conductor 16 and projectile launching rail 12. Firing switch 32 is connected across projectile launching rails 10 and 12 at the breech and serves to conduct current during the initial charging of inductor 30 and the augmenting conductors.

Figure 2:
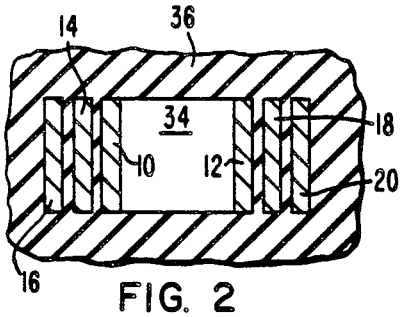
FIG. 2 PRIOR ART
FIG. 2 is a cross-sectional view of a prior art electromagnetic launcher rail assembly.

FIG. 2 is a cross-sectional view of a prior art augmented electromagnetic projectile launcher rail assembly which can be used in the launcher circuit of FIG. 1. This represents a twice augmented system where the projectile launching rails 10 and 12 line a bore 34 and have rectangular cross sections. Augmenting conductors 14, 16, 18, and 20 are positioned adjacent to the projectile launching rails and also have a rectangular cross section. All of the rails and conductors are held in place by a rigid insulating restraining structure 36. If augmenting conductors 16 and 20 were removed, a singly augmented system would remain. Similarly, if augmenting conductors 14 and 18 were also removed, a simple parallel rail launcher would result. A force augmentation factor can be defined as the ratio of the projectile propelling force in an augmented launcher to that force which would result from a simple parallel rail launcher which contains only projectile launching rails such as 10 and 12 of FIG. 2. Prior art externally augmented parallel rail launcher configurations, such as those of FIG. 2, ideally have a force augmentation factor of three for once augmented and five for twice augmented systems. Actual experiment and detailed computer calculations have shown that the force augmentation factors are well below these ideal values and are actually, for a practical configuration, roughly 2.3 and 3.6 respectively. The launchers of the present invention utilize projectile launching rails which have particular cross-sectional shapes to achieve projectile accelerating forces in excess of those available in a simple parallel rail launcher with rails having a rectangular cross section. In augmented embodiments, the present invention configurations yield force augmentation factors which can be above the previously considered maximum values of three for once augmented and five for twice augmented systems.

Figure 3:
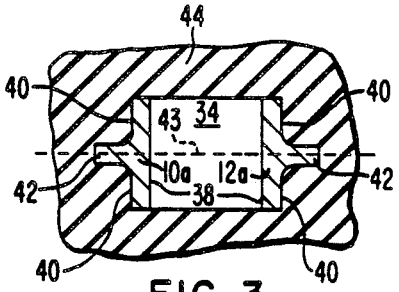
FIGS. 3, 4, 5, 7, 8, 9 and 10 are cross-sectional views of launcher rail assemblies constructed in accordance with alternative embodiments of the present invention.

Since the accelerating force is equal to $\frac{1}{2}$ $L'I^2$, increasing the inductance gradient clearly increases the force if the propelling current is held constant. For the sake of comparison, a simple square bore parallel rail launcher such as one which contains only projectile launching rails 10 and 12 of FIG. 2, has a computed inductance gradient $L'_{PA}=0.478$ $\mu$H/m. Near the breech region, when the projectile is still moving slowly, the rail current distribution should be uniform and the accelerating force will then be $\frac{1}{2}$ $L'_{PA}I^2$. FIG. 3 is a cross-sectional view of a pair of conductive projectile launching rails 10*a* and 12*a* in accordance with one embodiment of the present invention. Each of these rails includes an internal surface 38 adjacent to bore 34 and an external surface 40. A longitudinal protuberance 42 extends from each external surface 40 and is generally disposed along the mid-plane 43 of the rails. The rails are held by an insulating restraining structure 44. By using rails having this generally T-shaped cross section, there would still be substantially uniform current density in the rails in the wake of a just starting or slowly moving projectile, but now, the computed inductance gradient $L'_{PI}=0.606$ $\mu$H/m and a 27% increase in initial accelerating force, over that of a simple parallel launcher, has thus been achieved. This was accomplished by using the same conductor total cross sectional area but concentrating more conductor area near the horizontal centerline or mid-plane 43 of the rail configuration. This rail configuration can be beneficially utilized for two or three bore widths in the rear of the starting position of the armature to give a higher initial acceleration and for that length behond the armature starting location wherein near uniform current density is still attained closely enough behind the armature so that the FIG. 3 type of rail geometry increases the inductance gradient. In general, the lower the acceleration and the larger the bore, the longer the distance for which it will be advantageous to use the FIG. 3 type of rail geometry. Such configurations are particularly attractive for heavy projectile acceleration applications, such as missile or torpedo launching. It should be pointed out that there is no operational disadvantage to using the FIG. 3 rail cross section throughout the bore length. The areas adjacent to external surface 40 on either side of longitudinal protuberance 42 can, for example, be utilized to locate coolant passages.

Once a projectile travels faster than a few hundred meters per second, current penetration is so slow relative to armature speed that the field which produces the accelerating force is generated by current concentrated in a relatively thin skin depth, and the remainder of the rail cross section serves primarily for lowering both the time averaged rail ohmic resistance and the average adiabatic rail temperature after firing and temperature equalization. A rough approximation of the current diffusion into the rail metal can be obtained from the following formula:

$$\delta = \sqrt{\frac{\pi t \rho}{\mu}} \tag{1}$$

where t = time in seconds for the current to penetrate to the depth $\delta$ in meters $\mu = 4\pi \times 10^{-7}$ in non-ferromagnetic materials $\rho$ = resistivity in $\Omega$-m Using this formula, if an armature is traveling at a steady speed of 1,000 meters/sec, then penetration to only 0.5 cm of the copper rails will only occur at about 60 cm behind the armature and if the bore width were 5 cm, penetration to 0.5 cm would only occur in 12 bore widths behind the armature. Therefore, the accelerating force for this case at this instant would have to be calculated based on a rather thin current layer at the inner faces of the parallel rails.

Unfortunately, having a rather low rail thickness for the rails does not significantly change the inductance gradient. For example, using a uniform current density, a reduction in rail thickness of about 60%, for example from 1.3 cm to 0.5 cm, only results in a 5% increase in the inductance gradient over the reference value of 0.478 $\mu$H/m given previously for a simple parallel rail launcher.

Figure 4:
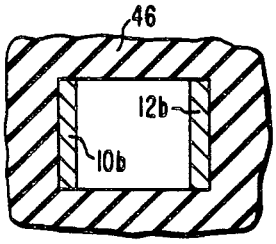

Pulse power systems utilized for accelerating a projectile in a parallel rail laucher have the characteristic of high breech currents and at least somewhat reduced currents at higher projectile velocities and towards the muzzle. For example, assume that for a particular acceleration scenario, the height of the bore rails 10*b* and 12*b*, in the breech region, as illustrated in FIG. 4 is adequate for conducting, to and from the armature, the maximum accelerating current with acceptable rail and armature wear. Calculations have been made for copper rails, which indicate that starting at room temperature, up to about 43 kiloamp per mm of rail height, or conducting rail perimeter, is allowable without rail surface melting. Experiments have actually somewhat exceeded this limit without rail damage. If then, towards the muzzle, the armature current level is reduced by for example 30%, the projectile rail height or conducting rail internal bore surface may also be reduced by 30% without exceeding the acceptable kiloamp/mm of rail height level. Furthermore, at higher velocities, the rail surface temperature rise resulting from the rail to armature heat flux is decreased because of the shorter residence time of the armature or plasma at a given rail location, and therefore, even more than a 30% rail height reduction is quite likely to be acceptable. Additionally, because the current level toward the muzzle end of the projectile rails is lower, the projectile rails toward the muzzle can have a lower cross-sectional area without exceeding an acceptable temperature limit after the temperature across the rail area has roughly equalized. Reducing the projectile rail cross-sectional area toward the muzzle is highly desirable. This can reduce barrel weight since rail mass per unit length adjacent to the breech end is greater than rail mass per unit length adjacent to the muzzle end. Barrel weight near the muzzle end can be further reduced since the rail spreading forces near the muzzle end are lower and lighter or less material can be used as rail spreading force restraining structural members toward the muzzle. However, just reducing the rail height by only 30%, for example, from 5 cm to 3.5 cm is calculated to result in a significant 18% acceleration force improvement over the full height, 0.5 cm boundary layer configuration.

Figure 5:
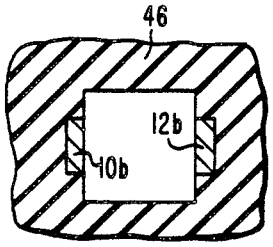

FIG. 5 is a cross section of the same parallel rail launcher as FIG. 4, but taken near the muzzle end. FIG. 5 shows that the reduction in rail height can be obtained by physically reducing rail height and replacing the lost volume with a portion of the insulating restraining structure 46. In this case, if one uses a metal armature, the extreme upper and lower armature portions will ride on the insulation which would be quite harmless and contact voltage drops can be expected to be too low to cause arcing. Alternatively, the rail area where no contact is desired can be simply recessed by machining away some of the rail contact surface metal so that the armature cannot contact this area. This latter scheme is of course not feasible for plasma drive systems.

Figure 6:
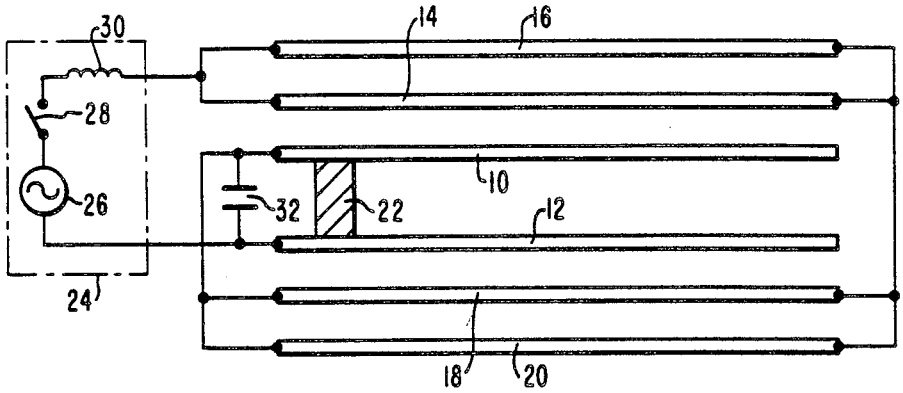
FIG. 6 is a schematic diagram of an alternative embodiment of the present invention.
Figure 7:
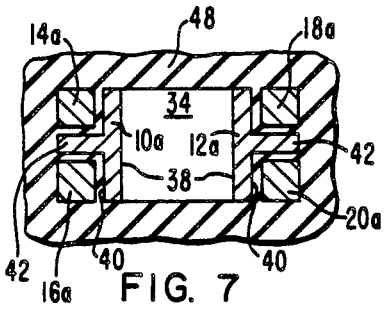

FIG. 7 shows the addition of augmenting conductors to the rail system of FIG. 3. In accordance with this invention, the two augmenting turns associated with each projectile launching rail may be connected in series or parallel. For the purposes of the discussion below, the terms once externally augmented and one external augmenting turn are considered to be synonymous. They both indicate that augmentation is by one turn conducting the full projectile current, but that one turn may physically consist of a number of augmenting conductors which are connected electrically in parallel. The augmenting conductors are geometrically in parallel with and adjacent to the projectile launching rails. As stated previously, a computer calculated inductance gradient for the simple parallel rail launcher having a uniform current distribution and the structure represented by only projectile launching rails 10 and 12 of FIG. 2, is $L'_{PA}=0.478$ $\mu$H/m. This calculation was based on a 50 mm$\times$50 mm bore and a rail cross section of 50 mm$\times$13 mm. If augmenting conductors 14*a*, 16*a*, 18*a* and 20*a* of FIG. 7 are assumed to have a 20 mm$\times$20 mm square cross section and are electrically connected in parallal as illustrated in FIG. 6, and if the interrail insulation thickness is neglected, then the resultant inductance gradient $L'_2$ computes to be equal to 1.663 $\mu$H/m or 3.48 times $L'_{PA}$. This equates to a force augmentation factor of 3.48 which is 16% above the previously considered theoretical maximum factor of three for a once externally augmented system. It should be understood that $L'_2=1.663$ $\mu$H/m is the value of L' in the formula for force, $F=\frac{1}{2}L'I^2$, that is, the value of L' which produces the projectile accelerating force. Computationally, the L' which produces the acceleration is the value of L' for only the augmenting conductors which carry current prior to the launch subtracted from the L' of the configuration which exists in the wake of the projectile during acceleration. The value of $L'_2$ as computed above assumes uniform current distribution in both the augmenting conductor cross sections and also in the T-shaped projectile launching rails. Such a uniform current distribution in the wake of the projectile will be approached throughout the bore length for large bore, low velocity, low acceleration applications involving heavy projectiles. For high velocity, high acceleration applications, the computed value of $L'_2$ will be appropriate only at and near the breech where the velocity is still moderate.

If the FIG. 7 configuration is used for a smaller bore, high acceleration and high velocity application, then the projectile rail current in the wake of the armature will be confined primarily to a thin layer facing the bore. This thin layer may be assumed to be a 5 mm layer, with no current flow in the longitudinal protuberance 42 between the augmenting conductors. This results in an effective inductance gradient value of 1.361 or 2.85 times the inductance gradient of the reference simple parallel rail launcher. Thus, in the high velocity rail bore portion, there will be a measurable decrease in the accelerating force but near to an augmentation factor of 3 will still be obtained.

Figure 8:
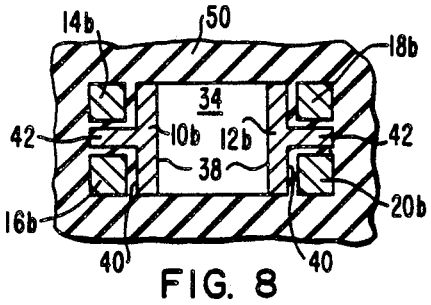
Figure 9:
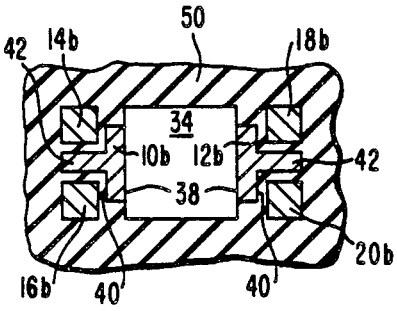

As already explained, in a pulse power system current decreases as the projectile passes down the bore. Therefore, toward the muzzle, the projectile rail height, or conducting projectile rail perimeter, can also be reduced. FIGS. 8 and 9 show-cross sectional views of a launcher rail system constructed in accordance with this invention, taken near the breech and near the muzzle ends respectively. The rail configuration of FIG. 8 is similar to that of FIG. 7. However, when FIGS. 8 and 9 are considered together, projectile launching rails 10*b* and 12*b* are seen to have a height reduction of approximately 30%. This rail height reduction is assumed to be justified by a roughly corresponding current reduction. The inductance gradient for FIG. 9 now computes to be 1.575 or 3.29 times the reference system inductance gradient. It should be noted that when the inductance gradient of FIG. 9 was calculated, it was assumed that no current flows in longitudinal protuberance 42.

Up to this point, we have shown that favorable once augmented electromagnetic launcher bore configurations as represented by FIGS. 7, 8 and 9 will result in force augmentation factors above 3 at the same projectile current as an unaugmented barrel. Thus these preferred embodiments attain far more improvement compared to the augmentation factors of about 2.2 and 2.4 which have been experimentally measured and detail computed for the prior art once augmented designs similar to that shown in FIG. 2.

It should be observed that the electrically in-parallel connection of the two augmenting conductors as illustrated in FIG. 6, is particularly attractive as it reduces the current density in the augmentation conductors. If an electromagnetic launcher is powered by a homopolar generator-inductor pulse compression system as shown in FIG. 6, then the augmenting turn conducts the charging current prior to the launch and it is necessary from an efficiency view point to have low resistance augmenting conductors as the charging period to full launch current tends to be relatively long, compared to the projectile acceleration duration. Furthermore, the lower current density in the augmenting conductors is additionally required to prevent their overheating. For the FIG. 7 configuration and uniform current distribution, and if interrail insulation is neglected, the current density in the augmenting conductors is calculated to be only about 56% of the projectile rail current density for the parallel augmenting conductor configuration and therefore for the same current flow duration, the augmenting turn would only experience 32% of the temperature rise of the projectile rails.

If the augmenting conductors of FIG. 7 were connected in series, each of the augmenting conductors then conducts the full projectile current thus yielding a twice externally augmented launcher configuration. For a uniform current distribution, the inductance gradient of this configuration is 2.509 $\mu$H/m, which is equal to 5.25 times the inductance gradient of the reference system and thus again above the previously considered unattainable limit of 5 for twice augmented designs. This yields a 44% improvement over the experimental and calculated augmentation factor which averages about 3.65 for the FIG. 2 prior art type of configuration for low velocity, low acceleration, larger bore launchers. For higher velocity smaller bore launchers, that improvement would be experienced during the initial acceleration with a somewhat reduced improvement in the higher velocity bore portion. In the high velocity bore portion, projectile rail height could then again be reduced to increase the inductance gradient and thus improve acceleration.

If the augmenting conductors of the FIG. 7 configuration are connected in series, this configuration could only be effectively used with a capacitively powered launcher, since the augmenting turns would have an excessive current density and hence excessive resistance and temperature rise if a homopolar generator-inductor pulse power source were utilized. For effective and efficient use with a homopolar generator-inductor pulse compression system, the horizontal dimensions of the augmenting turns can be roughly doubled which will still yield a force augmentation factor above 5 compared to the reference system.

Figure 10:
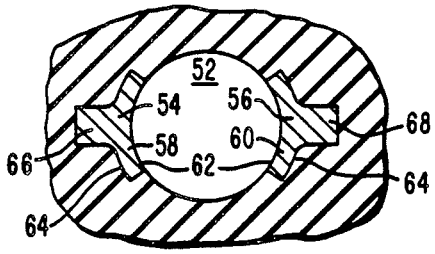

It should be noted that the preferred embodiments which involve a projectile rail configuration which is generally T-shaped, can be adapted to a round bore as shown in FIG. 10. In that Figure, a pair of generally parallel projectile launching rails 54 and 60 are arranged adjacent to bore 52. Each of these rails includes an arcuate portion 58 and 60 with an arcuate internal surface 62 and an external surface 64 which may also be arcuate. Longitudinal protuberances 66 and 68 are shown to extend from the external surface 64 of rails 54 and 56 respectively.

The electromagnetic launchers of this invention utilize particular rail shapes to increase projectile acceleration by increasing the inductance gradient of the rail assembly. Projectiles are accelerated in these launchers by a method which comprises the steps of: causing current flow through a pair of generally parallel projectile launching rails and through an armature, or means for conducting current between the rails and for propelling a projectile along the rails; and increasing the inductance gradient toward the muzzle end of the rails by decreasing rail height. Alternatively or additionally, the inductance gradient can be increased by using a rail configuration which concentrates the current carrying area of the rails near the mid-plane of the launcher bore.

Although the present invention has been described in terms of what are at present believed to be its preferred embodiments, it will be apparent that various changes may be made without departing from the scope of the invention. It is therefore intended that the appended claims cover all such changes.

What is claimed is:

1. A method of accelerating projectiles in a parallel rail electromagnetic projectile launcher comprising the steps of:

causing current flow through a pair of generally parallel projectile launching rails and through a means for conducting current between the rails and for propelling a projectile along the rails; and increasing the inductance gradient toward a muzzle end of the rails by decreasing the rail height from a breech end to said muzzle end, thereby increasing an accelerating force on said projectile, for a given current magnitude as said projectile travels toward said muzzle end, said force resulting from the interaction of a magnetic field produced by current flowing within said rails and current flowing within said means for conducting current.

2. A method of accelerating projectiles in a parallel rail electromagnetic projectile launcher comprising the steps of:

causing current flow through a pair of generally parallel projectile launching rails and through a means for conducting current between the rails and for propelling a projectile along the rails, wherein current flowing within said rails produces a magnetic field between said rails, said magnetic field interacting with current flowing within said means for conducting current to produce an accelerating force on said projectile; and decreasing the cross-sectional area of said rails from a breech end to a muzzle end thereby concentrating the current conducting area of the rails adjacent to the mid-plane of a bore between the rails and increasing said accelerating force for a given current magnitude as said projectile travels toward said muzzle end.

3. An electromagnetic projectile launcher comprising:

a pair of generally parallel conductive projectile launching rails, each of said rails including a breech end, a muzzle end, an internal surface, and an external surface;

an insulating structure supporting said rails and cooperating with said rails to form a bore having a mid-plane passing longitudinally through said rails, the internal surface of each of said rails lining said bore and said rails being symmetrically disposed along said mid-plane;

said internal surface of each of said rails decreasing in height from said breech end to said muzzle end, thereby providing an increasing inductance gradient in the direction of said muzzle ends;

a source of current connected to said rails;

means for conducting current between said rails and for propelling a projectile along said rails; and wherein current flowing within said rails produces a magnetic field between said rails, said magnetic field interacting with current flowing within said means for conducting current to produce an accelerating force on said projectile.

4. An electromagnetic projectile launcher as recited in claim 3, wherein each of said rails further includes a longitudinal protuberance extending from said external surface, and said longitudinal protuberances are generally disposed along the mid-plane of the rails.

5. An electromagnetic projectile launcher as recited in claim 3, wherein the cross-sectional area of said rails at said breech end is greater than the cross-sectional area of said rails at said muzzle end.

6. An electromagnetic projectile launcher as recited in claim 3, wherein the mass per unit length of said rails adjacent to said breech end is greater than the mass per unit length of said rails adjacent to said muzzle end.

7. An electromagnetic projectile launcher as recited in claim 4, further comprising:

a first pair of augmenting conductors disposed generally parallel to a first one of said rails, adjacent to the external surface of the first one of said rails, and on opposite sides of the protuberance on said first rail.

8. An electromagnetic projectile launcher as recited in claim 7, wherein the first pair of augmenting conductors associated with the first one of said rails are connected in series with each other and with said rails.

9. An electromagnetic projectile launcher as recited in claim 7, wherein the first pair of augmenting conductors associated with the first one of said rails are connected in parallel with each other and in series with said rails.

10. An electromagnetic projectile launcher comprising:

a pair of generally parallel conductive projectile launching rails, each of said rails including a breech end, a muzzle end, and an arcuate portion having an internal surface and an external surface;

an insulating structure supporting said rails and cooperating with said rails to form a bore having a mid-plane passing longitudinally through said rails, the internal surface of each of said rails lining said bore and said rails being symmetrically disposed along said mid-plane;

said internal surface of each of said rails decreasing in height from said breech end to said muzzle end, thereby providing an increasing inductance gradient in the direction of said muzzle ends;

a source of current connected to said rails;

means for conducting current between said rails and for propelling a projectile along said rails; and wherein current flowing within said rails produces a magnetic field between said rails, said magnetic field interacting with current flowing within said means for conducting current to produce an accelerating force on said projectile.

11. An electromagnetic projectile launcher as recited in claim 10, wherein said rails include a breech the cross-sectional area of said rails at said breech end is greater than the cross-sectional area of said rails at said muzzle end.

* * * * *